US007024719B2

(12) United States Patent
Wilmo

(10) Patent No.: US 7,024,719 B2
(45) **Date of Patent: *Apr. 11, 2006**

(54) SWEEPER DRAG SHOE

(75) Inventor: Michael S. Wilmo, Crystal, MN (US)

(73) Assignee: Tennant Company, Minneapolis, MN (US)

( * ) Notice: Subject to any disclaimer, the term of this patent is extended or adjusted under 35 U.S.C. 154(b) by 395 days.

This patent is subject to a terminal disclaimer.

(21) Appl. No.: 10/236,102

(22) Filed: Sep. 6, 2002

(65) Prior Publication Data

US 2004/0045110 A1 Mar. 11, 2004

(51) Int. Cl.
*E01H 1/05* (2006.01)

(52) U.S. Cl. ..... 15/82; 15/83; 15/246

(58) Field of Classification Search ..... 15/78, 15/82–86, 246
See application file for complete search history.

(56) References Cited

U.S. PATENT DOCUMENTS

| | | | | | |
|---|---|---|---|---|---|
| 2,917,761 | A | * | 12/1959 | Burgdorff | 15/84 |
| 3,008,542 | A | | 11/1961 | Steele | 55/287 |
| 3,588,937 | A | * | 6/1971 | Scruggs et al. | 15/84 |
| 3,604,051 | A | | 9/1971 | Wendel et al. | 15/340.4 |
| 3,639,940 | A | | 2/1972 | Carlson et al. | 15/352 |
| 3,756,416 | A | | 9/1973 | Wood | 210/408 |
| 3,792,569 | A | | 2/1974 | Carlson et al. | 55/288 |
| 3,881,215 | A | | 5/1975 | Krier et al. | 15/340.1 |
| 3,926,596 | A | | 12/1975 | Coleman | 55/304 |
| 3,997,934 | A | * | 12/1976 | Toews | 15/246 |
| 4,017,281 | A | | 4/1977 | Johnstone | 55/334 |
| 4,450,601 | A | * | 5/1984 | Shwayder | 15/246 |
| 4,489,458 | A | * | 12/1984 | Schwayder | 15/246 |
| 4,578,840 | A | | 4/1986 | Pausch | 15/352 |
| 4,660,248 | A | | 4/1987 | Young | 15/340.1 |
| 4,754,521 | A | | 7/1988 | Zoni | 15/340.1 |
| 4,759,781 | A | | 7/1988 | Olson | 96/427 |
| 4,872,233 | A | * | 10/1989 | Brown | 15/83 |
| 4,951,342 | A | * | 8/1990 | Wilson | 15/246 |
| 5,006,136 | A | | 4/1991 | Wetter | 55/290 |
| 5,940,919 | A | * | 8/1999 | Vanderlinden | 15/84 |
| 6,041,464 | A | * | 3/2000 | Ebersole | 15/83 |
| 6,192,542 | B1 | | 2/2001 | Frederick et al. | 15/84 |
| 6,195,836 | B1 | | 3/2001 | Vanderlinden | 15/340.3 |
| 6,195,837 | B1 | | 3/2001 | Vanderlinden | 15/348 |

FOREIGN PATENT DOCUMENTS

| | | |
|---|---|---|
| DE | 1253242 | 12/1967 |
| DE | 1256241 | 12/1967 |
| EP | 0453177 | 4/1991 |
| WO | 03/069071 | 2/2003 |

* cited by examiner

*Primary Examiner*—Mark Spisich
(74) *Attorney, Agent, or Firm*—Altera Law Group, LLC

(57) ABSTRACT

A sweeper drag shoe used with a rotary broom in sweeping, whereby escaping debris from under a contact skid is recaptured. The sweeper drag shoe contains a deflection plate that redirects bristle tip movement inwardly to allow the broom to recapture debris which escapes during normal operation. The sweeper drag shoe also includes an angled wedge for concentrating outer bristles of the broom into a rotating barrier to prevent debris migration to the end of the broom.

16 Claims, 12 Drawing Sheets

SWEEPER DRAG SHOE

CROSS REFERENCES TO RELATED APPLICATIONS

None.

BACKGROUND OF THE INVENTION

1. Field of the Invention

The present invention is for a sweeper drag shoe used in a sweeping operation, and more particularly, pertains to a sweeper drag shoe with a deflection plate and a contact skid utilized for accomplishing substantially complete dirt and debris collection by a street sweeper.

2. Description of the Prior Art

Prior art sweeper drag shoes have uniformly been designed as a shaped linear piece of metal. A sweeper drag shoe performs a critical containment function in street sweeping machines. A rotary broom is mounted on a supporting axle and the bottom regions of the rotary broom align in close proximity to the inner surfaces of opposing sweeper drag shoes. Sweeper drag shoes define the boundary of the sweeping area, and can serve to mount skirted panels surrounding the lower edges of the rotary broom and sealingly contact the road surface as the mobile street sweeper accomplishes its sweep. One drawback of this configuration is that a wedge of dirt and debris rapidly builds up in front of the rotary broom during its sweeping action, and this wedge, like a wedge of water, builds and drifts to the ends of the rotary broom. The typical sweeper drag shoe is intended to form a seal on either end of the lower edges of the rotary sweeper broom to contain the dirt wedge. The current art sweeper drag shoe design allows dirt and debris to escape beneath the sweeper drag shoe, particularly on uneven surfaces, resulting in an incomplete collection of dirt and debris at the edges of the sweeping path.

What is needed is a sweeper drag shoe that will provide for an improved seal along the forward portion of the sweeper drag shoe and which will allow the broom to collect and redirect the escaping wedge of dirt and debris which exits from beneath the sweeper drag shoe.

The present invention provides an improved forward portion seal and provides means to contain and redirect the escaping wedge portion of dirt and debris.

SUMMARY OF THE INVENTION

The general purpose of the present invention is to provide for a more complete means of collecting dirt and debris in the process of road sweeping by providing an improved drag shoe. The sweeper drag shoe can be provided as a right-hand version, as shown herein, or as a left-hand version mirror image likeness where each is utilized on opposing sides of a rotary broom in a sweeping truck.

The sweeper drag shoe includes a longitudinally extending and horizontally oriented planar contact skid, a longitudinally extending and vertically oriented planar attachment bar extending substantially at a right angle vertically from the planar contact skid, an angled wedge extending along the inner and lower side of the planar attachment bar, a vertically oriented deflection plate mounted at an angle with respect to and at the rear region of the longitudinal axis of the planar attachment bar, and, an angled plate extending between the planar contact skid and the planar attachment bar at the forward region or nose of the sweeper drag shoe. An enhanced (forward) seal at the central portion of the sweeper drag shoe is provided in the region of and forward of tangential and near tangential brush contact with the angled wedge extending partially along the inner and lower side of the planar attachment bar whereby the rotating broom outer bristles are forced together to provide a thicker bristle population which acts as a unified rotating barrier. At the rear region of the sweeper drag shoe redirection and recapture of unwanted dirt and debris exiting from the area below the sweeper drag shoe is accomplished by alteration and influencing of the behavior of the rotating broom outer bristles.

In accordance with the present invention, the combination of the attachment bar and plate form a broom bristle compression member having a tapered end section, the structure of which may be implemented by a wide array of structural details all of which are intended to be within the true spirit and scope of the present invention. Most specifically, the description of the invention has been depicted employing right angle members for illustrative purposes. However, the members need only be transverse to the road surface in order to compress the broom bristles in a manner as described in the figures.

Similarly, the wedge or skirt as depicted in the drawings may have other contours beyond that illustrated herein. For example, lowest most portion of the combination of the attachment bar and skid need only be contoured so to provide the most compression of the broom bristles toward the central axis of the broom as compared to other portions away from the road surface.

It should be recognized by those skilled in the art that the structure as depicted in the drawings may be implemented by a wide array of structural details and assemblies. Although the structure has been illustrated by way of generally planar stock materials, it may be constructed of tubular materials as well. Although the skid has been illustrated as one elongated piece of stock material, it may be constructed by way of a forward end piece having a slanted formed end member and a rearward end, both of which are assembled together by way of the transverse bar member. The wedge or skirt, although illustrated as a separate member, may, of course, be formed into the attachment bar or the skid itself, depending, of course, upon the chosen assembly techniques.

During normal prior art sweeping operations, the outer bristles are splayed outwardly in an outward and transverse direction to a magnitude approximately equalling the width of the sweeper drag shoe and the dirt and debris escaping from the bottom thereof. Incorporation of the present invention requires the sweeper drag shoes to be offset towards the center of the sweep path slightly. Such offsetting brings the outwardly splayed ends of the outer bristles into contact with the deflection plate at the rearward region of the sweeper drag shoe. Such contact of the rotating outwardly splayed bristle ends with the angled deflection plate redirects and urges the rotating outer bristle ends or tips inwardly towards the center of the sweep path, thereby sweeping and carrying the dirt and debris once again into the wedge and into the more centrally located region of the sweeping path of the rotary broom.

According to one embodiment of the present invention, there is included a longitudinally extending and horizontally oriented planar contact skid, a longitudinally extending and vertically oriented planar attachment bar extending substantially at a right angle vertically from the planar contact skid, an angled wedge extending along the inner and lower side of the planar attachment bar, a vertically oriented deflection plate mounted at an angle with respect to and at the rear region of the longitudinal axis of the planar attachment bar, and, an angled plate extending between the planar contact skid and the planar attachment bar at the forward region or nose of the sweeper drag shoe.

One significant aspect and feature of the present invention is the ability to recapture dirt and debris which exits from beneath a sweeper drag shoe.

Another significant aspect and feature of the present invention is a deflection plate located at the rear of the sweeper drag shoe.

Yet another significant aspect and feature of the present invention is a deflection plate which redirects rotating broom bristles inwardly and transversely to sweep dirt and debris inwardly and transversely.

Still another significant aspect and feature of the present invention is an angled wedge extending along the lower and inner side of the planar attachment bar for improved sealing to prevent migration of dirt and debris during straight-ahead sweeping or sweeping in a turn.

Yet another significant aspect and feature of the present invention is an optional deflection plate extender which provides for additional and higher level broom bristle redirection over that normally provided by a first detection plate.

Having thus described embodiments of the present invention and enumerated significant aspects and features thereof, it is the principal object of the present invention to provide a sweeper drag shoe which functions to attain substantially complete debris collection in a road sweeping operation.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1A:
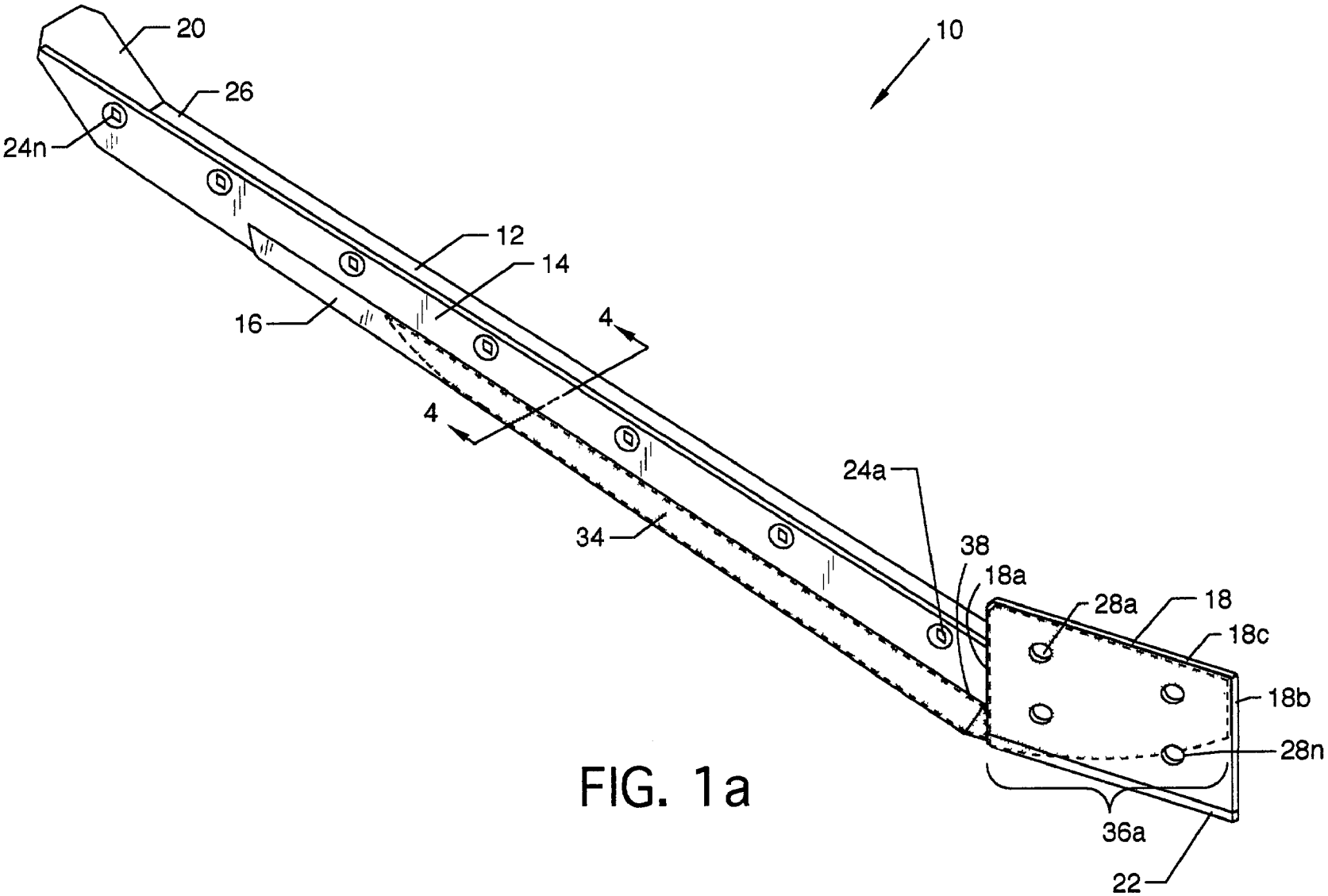
FIG. 1*a* illustrates an isometric view of one side of a sweeper drag shoe.
Figure 2A:
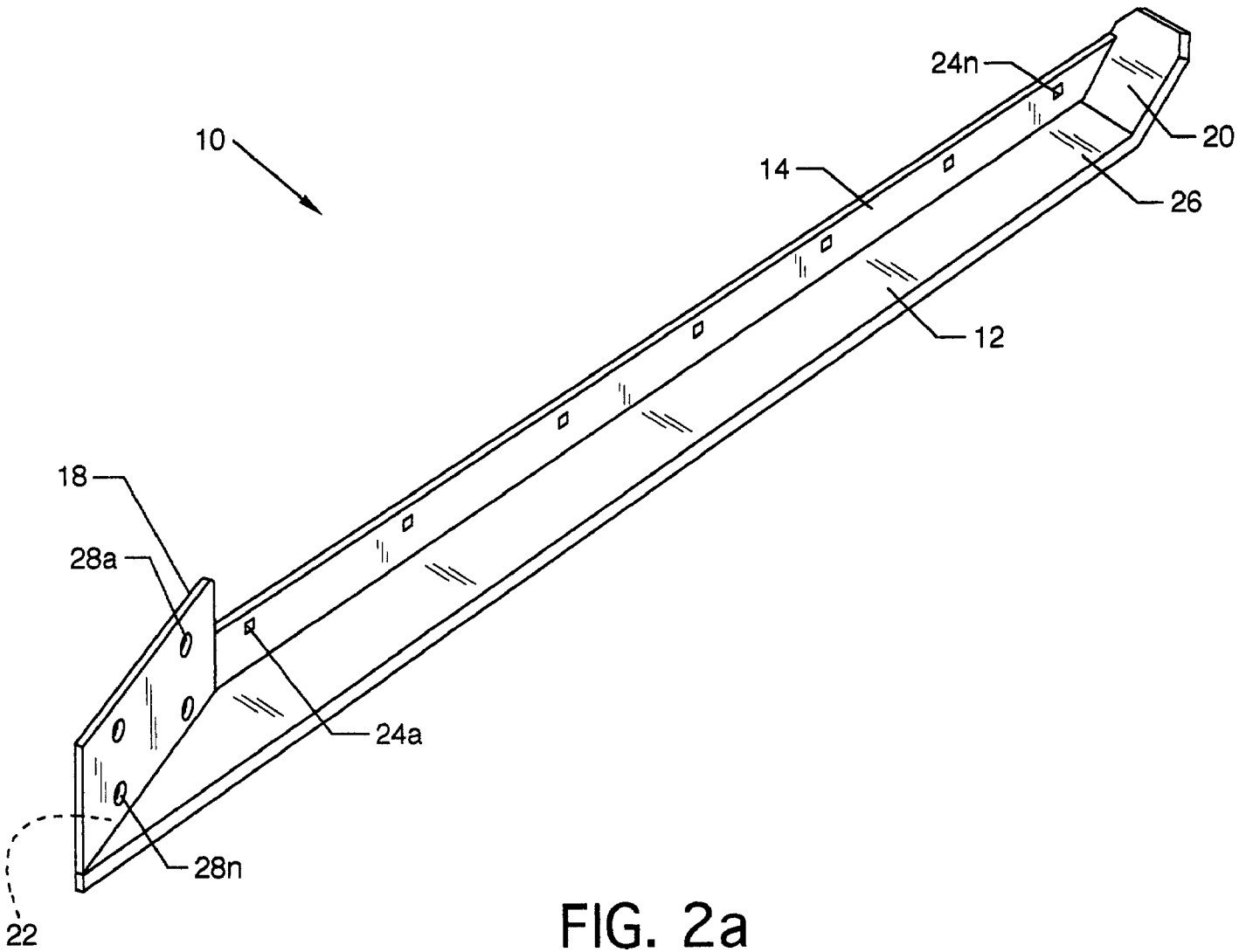
FIG. 2*a* illustrates an isometric view of the opposing side of the sweeper drag shoe.

FIG. 1*a* illustrates an isometric view of one side, and FIG. 2*a* illustrates an isometric view of the opposing side of a sweeper drag shoe 10, the present invention. The major components of the present invention 10 include a contact skid 12, an attachment bar 14, an angled wedge 16 (FIG. 1*a*), a deflection plate 18 having a leading edge 18*a*, a trailing edge 18*b* and a top edge 18*c*, and an angled plate 20. The structure of the sweeper drag shoe 10 centers about the longitudinally extending and horizontally oriented planar contact skid 12. The contact skid 12 includes a tapered region 22 at the trailing edge which is suitably angled to which the deflection plate 18 partially and accommodatingly aligns and mounts. The longitudinally extending and vertically oriented planar attachment bar 14, including mounting holes 24*a*–24*n*, extends substantially at a right angle vertically from the planar contact skid 12 and longitudinally from the forward end 26 of the contact skid 12 to the tapered region 22 of the contact skid 12. The attachment bar 14 serves as an attachment point for support arms, skirts, panels and the like. The angled wedge 16 (FIG. 1*a*) extends along the inner and lower side of the planar attachment bar 14. The vertically oriented deflection plate 18, including mounting holes 28*a*–28*n*, mounts at an angle with respect to the longitudinal axis of the planar attachment bar 14 and of the contact skid 12 in alignment with the tapered region 22 at the rear of the contact skid 12. The angled plate 20 extends between the contact skid 12 and the attachment bar 14 at the forward end 26 or nose of the sweeper drag shoe 10.

Figure 1B:
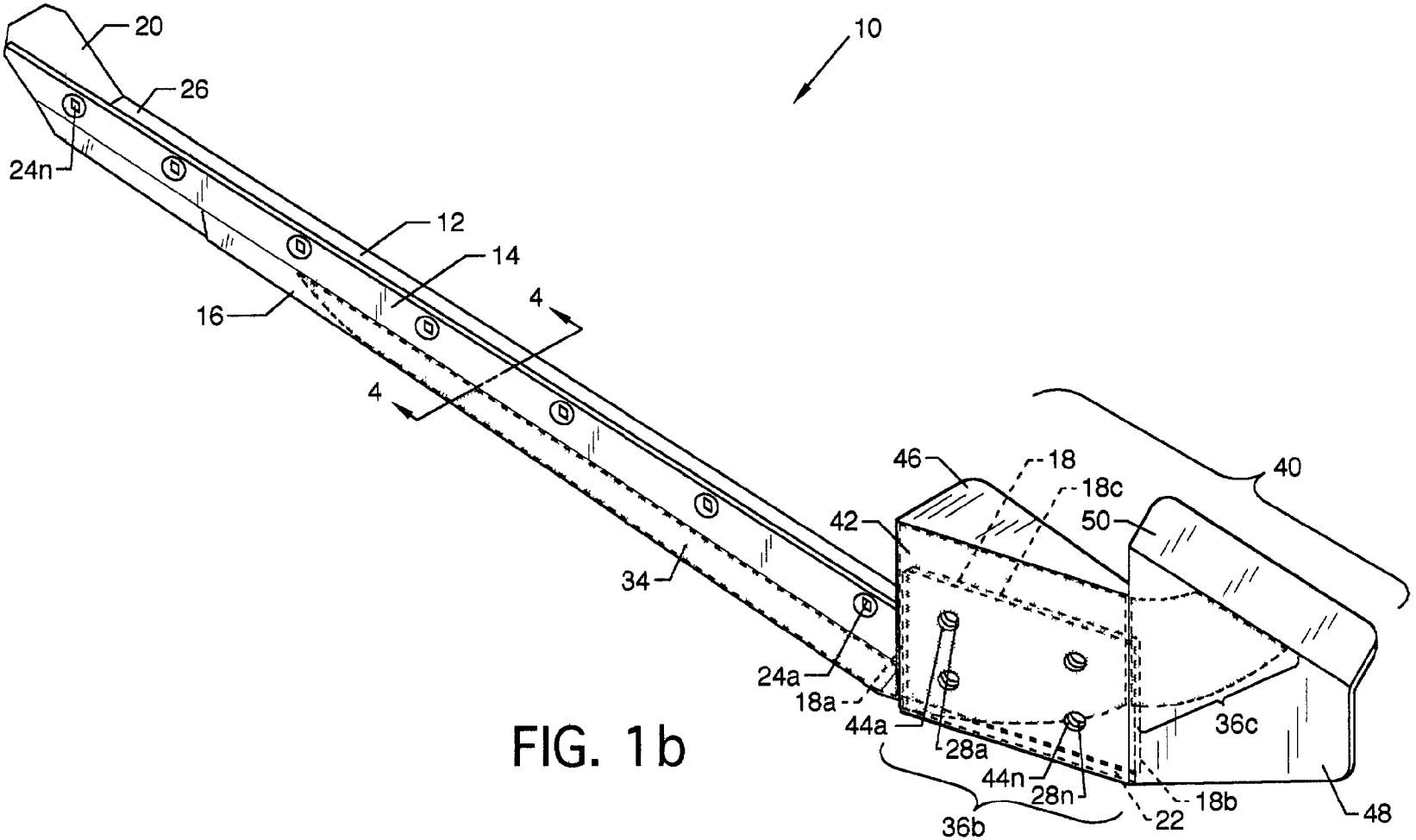
FIG. 1*b* illustrates an isometric view of one side of a sweeper drag shoe including an optional deflection plate extender.

FIG. 1*b* illustrates the sweeper drag shoe 10 of FIG. 1*a* including an optional deflection plate extender 40 secured over and about the deflection plate 18 to lend additional guidance of rotary broom bristles as later described in detail. The deflection plate extender 40 includes several plates having an angular relationship to other plates of the deflection plate extender 40. Each individual plate of the deflection plate extender 40 can be bent or angled to extend at an angle from the main portion of the plate. The deflection plate extender 40 can be one piece or can be an assembly of plates joined such as by welding. For purposes of illustration and example the deflection plate extender 40 is described as individual plates although the plates may be connected or may have portions extending therefrom. A vertically aligned deflection plate 42, including a plurality of mounting holes 44*a*–44*n*, having a greater vertical dimension than the deflection plate 18 and extending upwardly beyond the top edge 18*c* of the deflection plate 18 secures to and over the deflection plate 18 using suitable hardware which is accommodated by the mounting holes 44*a*–44*n* of the deflection plate 42 and mounting holes 28*a*–28*n* of the deflection plate 18. The deflection plate 42 has the same angular relationship with respect to the longitudinal axis of the planar attachment bar 14 and of the contact skid 12 in alignment with the tapered region 22 at the rear of the contact skid 12 that is exhibited by the deflection plate 18. A horizontally oriented plate 46 extends preferably at a right angle or any desirable angle outwardly from the upper region of the deflection plate 42. Another vertically oriented and geometrically configured containment plate 48 extends rearwardly and at an angle from the deflection plate 42 the planar region of which is parallel to the vertically aligned planar region of the attachment bar 14. An angled plate 50 extends upwardly and preferably at an angle from the upper region of the containment plate 48.

Figure 2B:
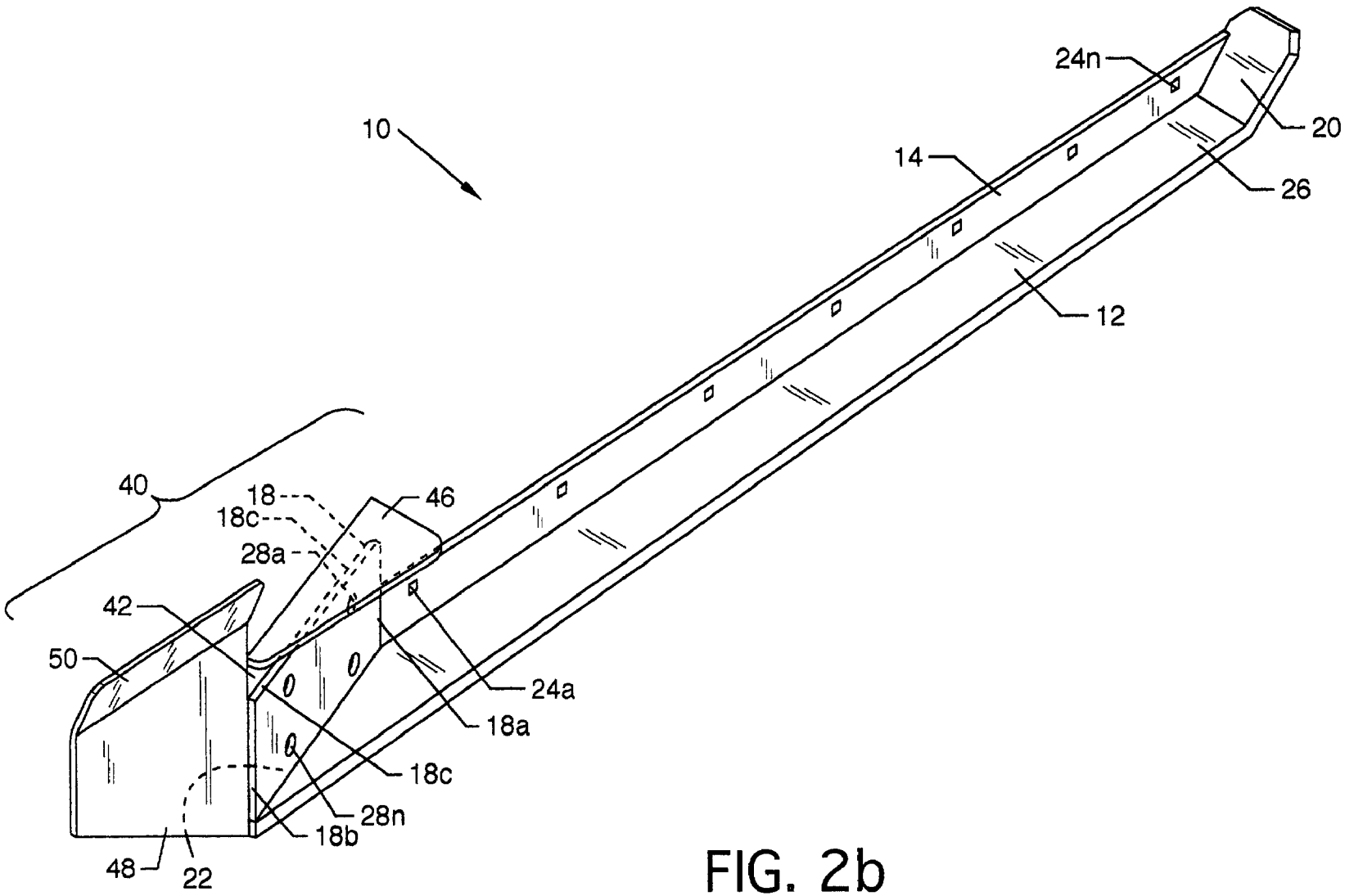
FIG. 2*b* illustrates an isometric view of the opposing side of the sweeper drag shoe including an optional deflection plate extender.

FIG. 2*b* illustrates the sweeper drag shoe 10 of FIG. 2*a* including an optional deflection plate extender 40 secured over and about the deflection plate 18 to lend additional guidance of the rotary broom bristles as later described in detail.

Figure 3A:
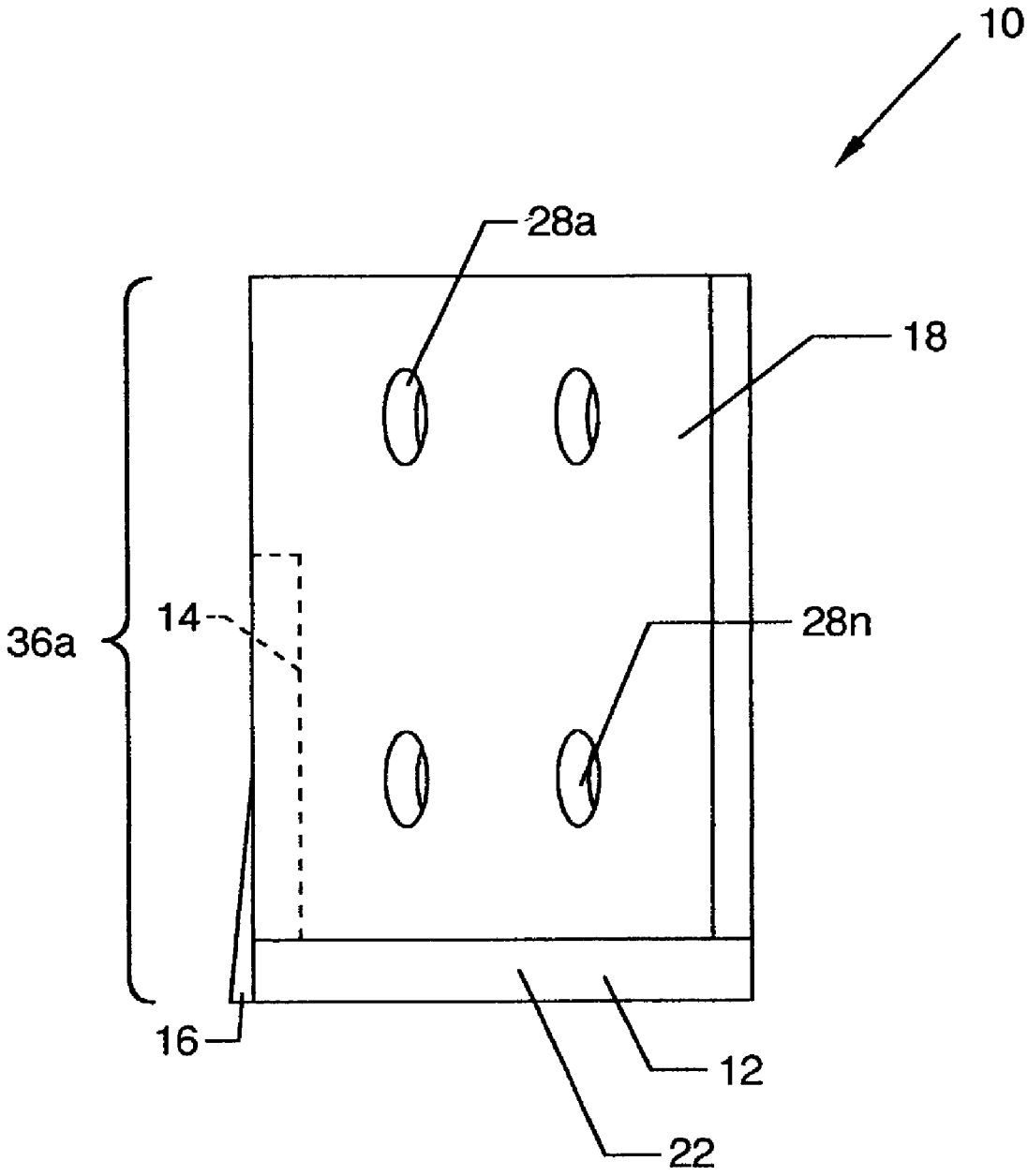
FIG. 3*a* is a rear view of the sweeper drag shoe showing the general configuration of the deflection plate and the angled wedge of the sweeper drag shoe.

FIG. 3*a* illustrates a rear view of the sweeper drag shoe 10. Illustrated in particular is the general configuration of the deflection plate 18 and the angled wedge 16 which extends outwardly from and longitudinally along the inner and lower side of the planar attachment bar 14. The angled wedge 16 extends a sufficient height vertically along the attachment bar 14 so as to compress bristles 30 or 30*a*–30*n* inwardly.

Figure 3B:
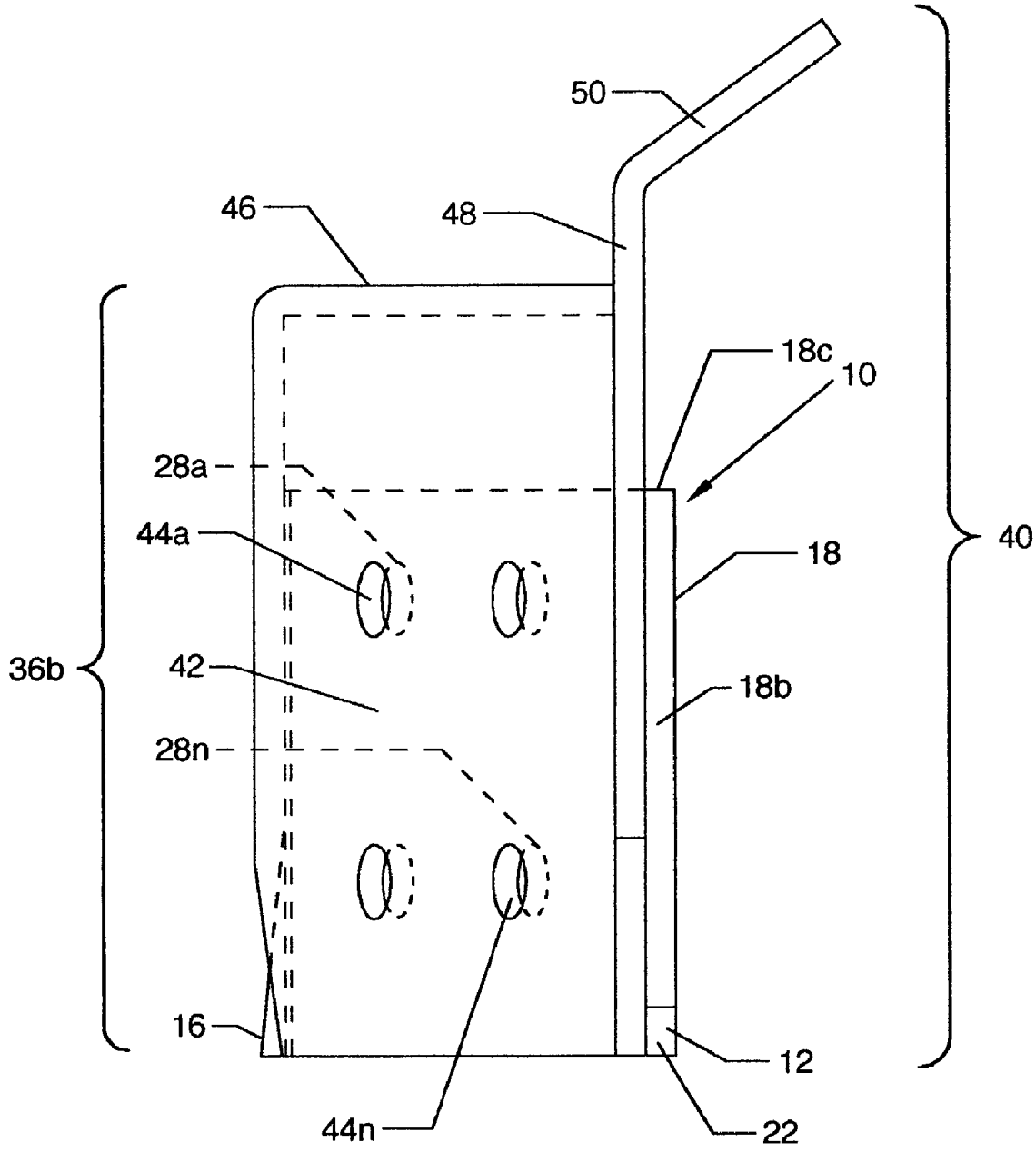
FIG. 3*b* is a rear view of the sweeper drag shoe showing the general configuration of the deflection plate and the angled wedge of the sweeper drag shoe and including an optional deflection plate extender.

FIG. 3*b* illustrates the sweeper drag shoe 10 of FIG. 3*a* including an optional deflection plate extender 40 secured over and about the deflection plate 18 to lend additional guidance of the rotary broom bristles as later described in detail.

Figure 4:
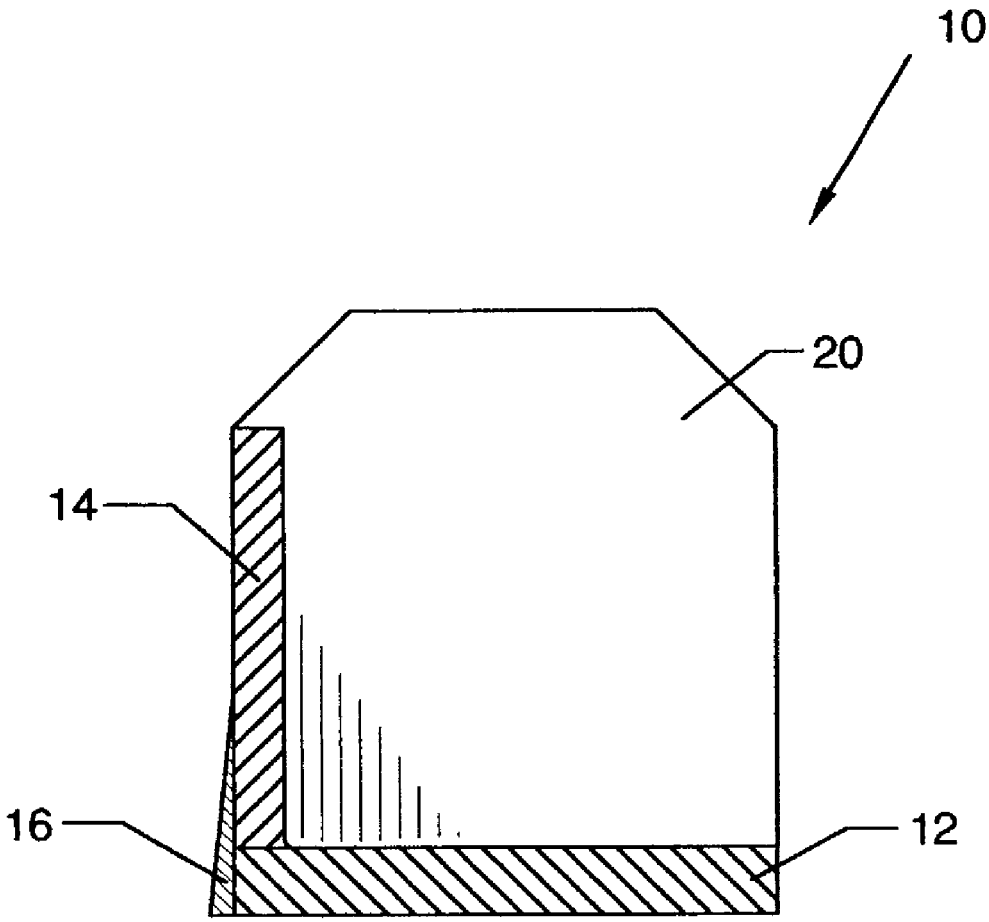
FIG. 4 illustrates a cross section view of the sweeper drag shoe along line 4—4 of FIG. 1.

FIG. 4 illustrates a cross section view of the sweeper drag shoe 10 along line 4—4 of FIG. 1*a*. Although the cross section indicates the contact skid 12, the attachment bar 14, and the angled wedge 16 as being separate components such as may be joined by welding, rivetting, or the like, these parts can be formed as one unitary piece having the overall cross section indicated in the figure without departing from the scope of the present invention.

MODE OF OPERATION

The sweeper drag shoes 10, the present invention, function as seals on the ends of rotary brooms or brushes during street sweeping operations. The present invention allows for more complete sweeping by creating an improved seal along a forward region of rotary broom contact with the angled wedge 16 and also by redirecting wedged debris that manages to escape beneath the contact skid 12 which is influenced by outer broom bristles which are redirected by the deflection plate 18 as the sweeper encounters uneven road surfaces. Previous sweeper drag shoes have allowed wedged debris to escape under and around the sweeper drag shoe during normal operation. The present invention allows the broom to capture the spilled or escaped wedged debris as the debris passes below the footprint of the sweeper drag shoe 10. The deflection plate 18 of the sweeper drag shoe 10 provides a suitable surface against which outer bristles of a rotary broom can impingingly contact in order to produce inwardly directed sweeping action that will collect and redirect the debris escaping from beneath the sweeper drag shoe 10.

The mode of operation is now shown and described with reference to FIGS. 5*a*, 5*b*, 6*a*, 6*b* and 7.

Figure 5A:
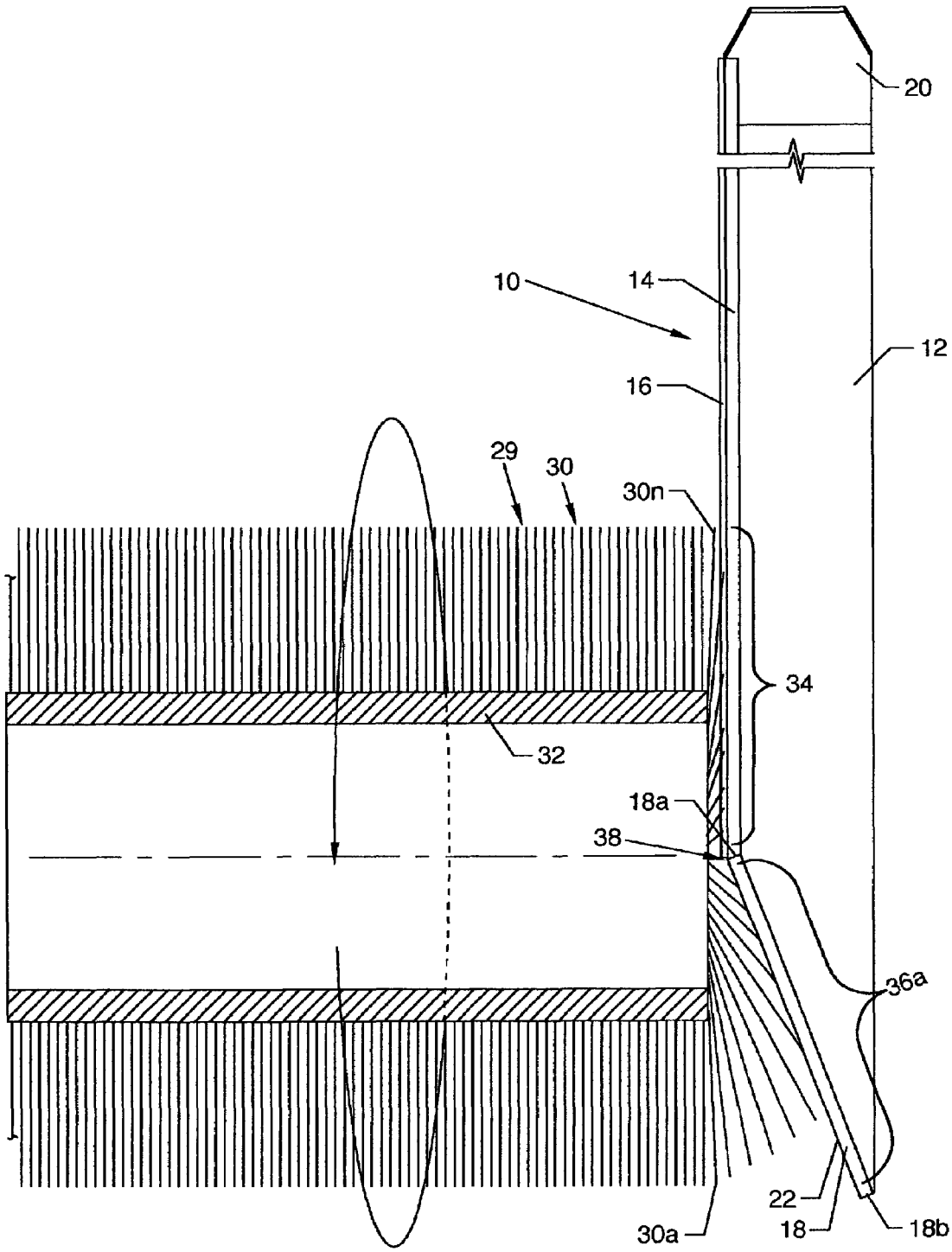
FIG. 5*a* illustrates a top view of the present sweeper drag shoe mounted relative to a rotary broom, shown in cross section, and further illustrates the rotary broom rotationally contacting the sweeper drag shoe angled wedge and deflection plate during the sweeping operation.

FIG. 5*a* illustrates a top view of the sweeper drag shoe 10 in active use with a rotary broom 29, shown in cross section, which includes a plurality of sets of bristles 30 arranged in rows extending outwardly in radial fashion from a central rotary broom hub 32. Attention is directed to a plurality of outer bristles 30*a*–30*n* which are located at the end of the rotary broom hub 32. Contact of the ends of the outer bristles 30*a*–30*n* with the sweeper drag shoe 10 is significant and beneficial to thorough and complete sweeping in a rearward contact region 36*a* and in a forward contact region 34, the regions of which are best shown in FIG. 1*a*. The forward contact region 34 extends as a region having one side being arced in correspondence to the tip movement and impingement path of the outer bristles 30*a*–30*n* along a portion of the angled wedge 16 from the intersection 38 of the angled wedge 16 and the deflection plate 18, as also viewed in FIG. 1*a*. The rearward contact region 36*a* extends as a region having one side being arced in correspondence to the tip movement and impingement path of the outer bristles 30*a*–30*n* along a major portion of the deflection plate 18 extending from a portion of the trailing edge 18*b* of the deflection plate 18 to the leading edge 18*a* of the deflection plate 18 and to the rearward extent of the angled wedge 16 (intersection 38), as also viewed in FIG. 1*a*. As the rotary broom 29 is rotated, the tips of the bristles 30 are brought into forced contact with the road surface resulting in bristle loading resulting in sideways directed displacement or outward splaying of the uncontained outer bristles 30*a*–30*n* in a direction away from the bristles 30 inboard of the outer bristles 30*a*–30*n*. Constant and repeated sideways displacement of the outer bristles 30*a*–30*n* causes the outer bristles 30*a*–30*n* to maintain an outwardly directed set whereby the outer bristles 30*a*–30*n* are angled outwardly from the rotary broom hub 32. During rotation of the rotary broom 29, the outer bristles 30*a*–30*n* are influenced and redirected to prevent debris and dirt from gathering beneath the sweeper drag shoe 10 and/or to sweep debris and dirt which may inadvertently find its way under the sweeper drag shoe 10 back into the main sweeping path. Accordingly, the sweeper drag shoes 10 are suitably aligned with the outer bristles 30*a*–30*n* of the rotary broom 29.

Figure 5B:
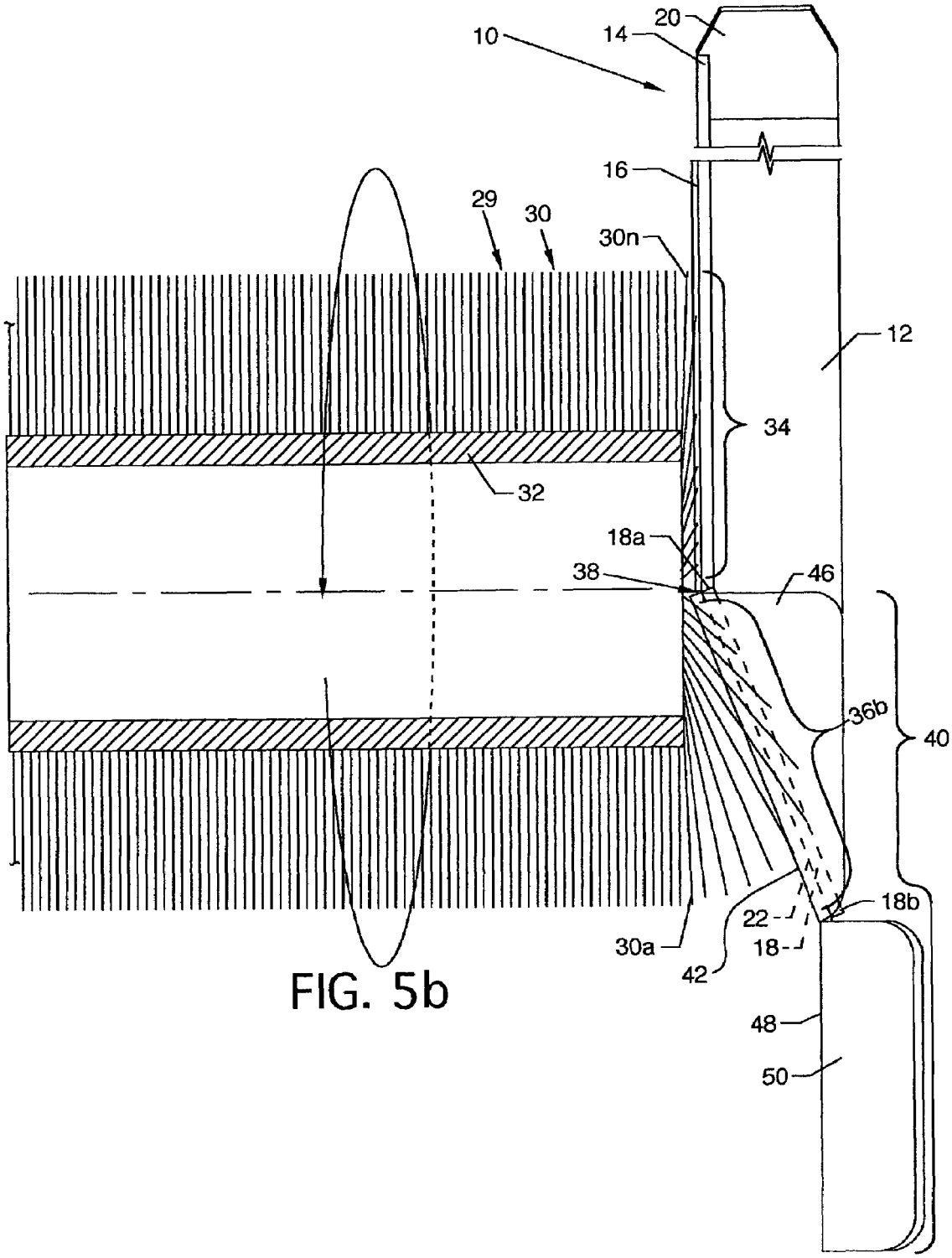
FIG. 5*b* illustrates a top view of the present sweeper drag shoe mounted relative to a rotary broom, shown in cross section, and further illustrates the rotary broom rotationally contacting the sweeper drag shoe angled wedge and deflection plate of the optional deflection plate extender during the sweeping operation.

FIG. 5*b* illustrates a top view of the sweeper drag shoe 10 of FIG. 5*a* in active use with a rotary broom 29 where the optional deflection plate extender 40 is attached to the sweeper drag shoe 10 to provide for additional upper level guidance of the outer bristles such as bristles 30*a*–30*n* which may be excessively splayed outwardly in a direction away from the bristles 30 inboard of the outer bristles 30*a*–30*n*. The optional deflection plate extender 40 is useful where the bristles 30*a*–30*n* are of a length where the bristles require extra guidance or where the bristles 30*a*–30*n* could incur damage if impingement with the upper edge 18*c* of the deflection plate 18 could occur if the optional deflection plate extender 40 were not used. Plate 46 of the optional deflection plate extender 40 prevents contact of the outer bristles 30*a*–30*n* with the upper edge 18*c* of the deflection plate 18. As shown in FIG. 1*b*, the optional deflection plate extender 40 includes a rearward contact region 36*b* along and about the deflection plate 42, similar in many respects to the rearward contact region 36*a* of the deflection plate 18 but extending upwardly to include the vertically extended portion of the deflection plate 42. Correspondingly, another rearward contact region 36*c* is located along and about the containment plate 48. The containment plate 48 and the angled plate 50 can be incorporated to provide for a seal with panels surrounding the rotary broom 29 (not shown).

Figure 6A:
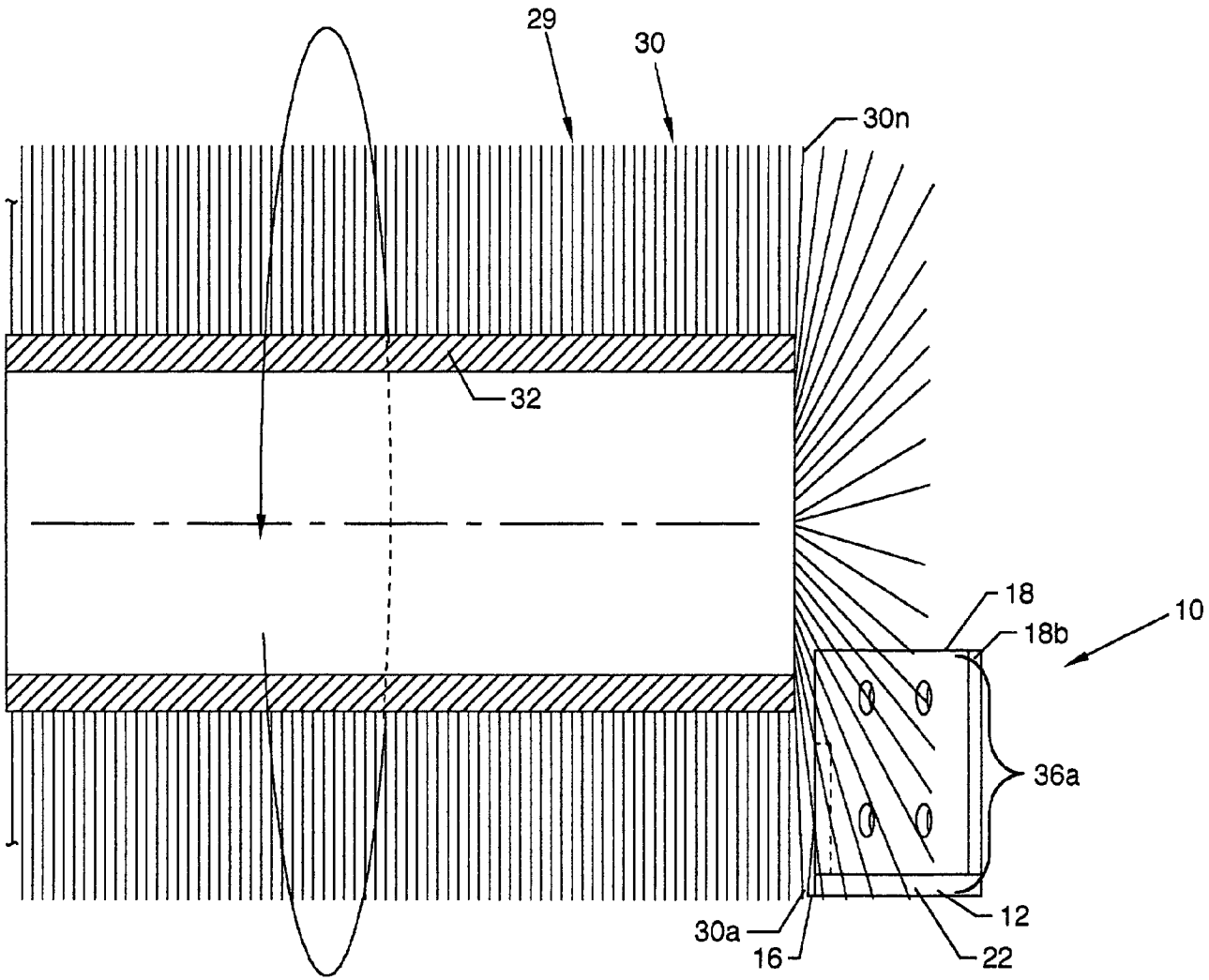
FIG. 6*a* illustrates a rear view of the rotary broom, shown in cross section, and the sweeper drag shoe, illustrating the interaction of the rotary broom with the rearward contact region of the deflection plate.

FIG. 6*a*, a rear view, illustrates a portion of the outer bristles 30*a*–30*n* in contact with the rearward contact region 36*a* of the deflection plate 18 of the sweeper drag shoe 10. During rotation of the rotary broom 29, the outwardly splayed outer bristles 30*a*–30*n* are urged inwardly by rotationally induced contact with the deflection plate 18. Just prior to contacting the deflection plate 18, the tips of the outer bristles 30*a*–30*n* contact the road surface just behind the tapered region 22 of the contact skid 12 to momentarily urge the dirt and debris in a forward direction followed by inward and forward movement of the tips of the outer bristles 30*a*–30*n* to urge and carry the dirt and debris to a more centrally located position where sweeping away of the dirt and debris can be accomplished by the central bristles 30 which are inboard of the outer bristles 30*a*–30*n*.

Figure 6B:
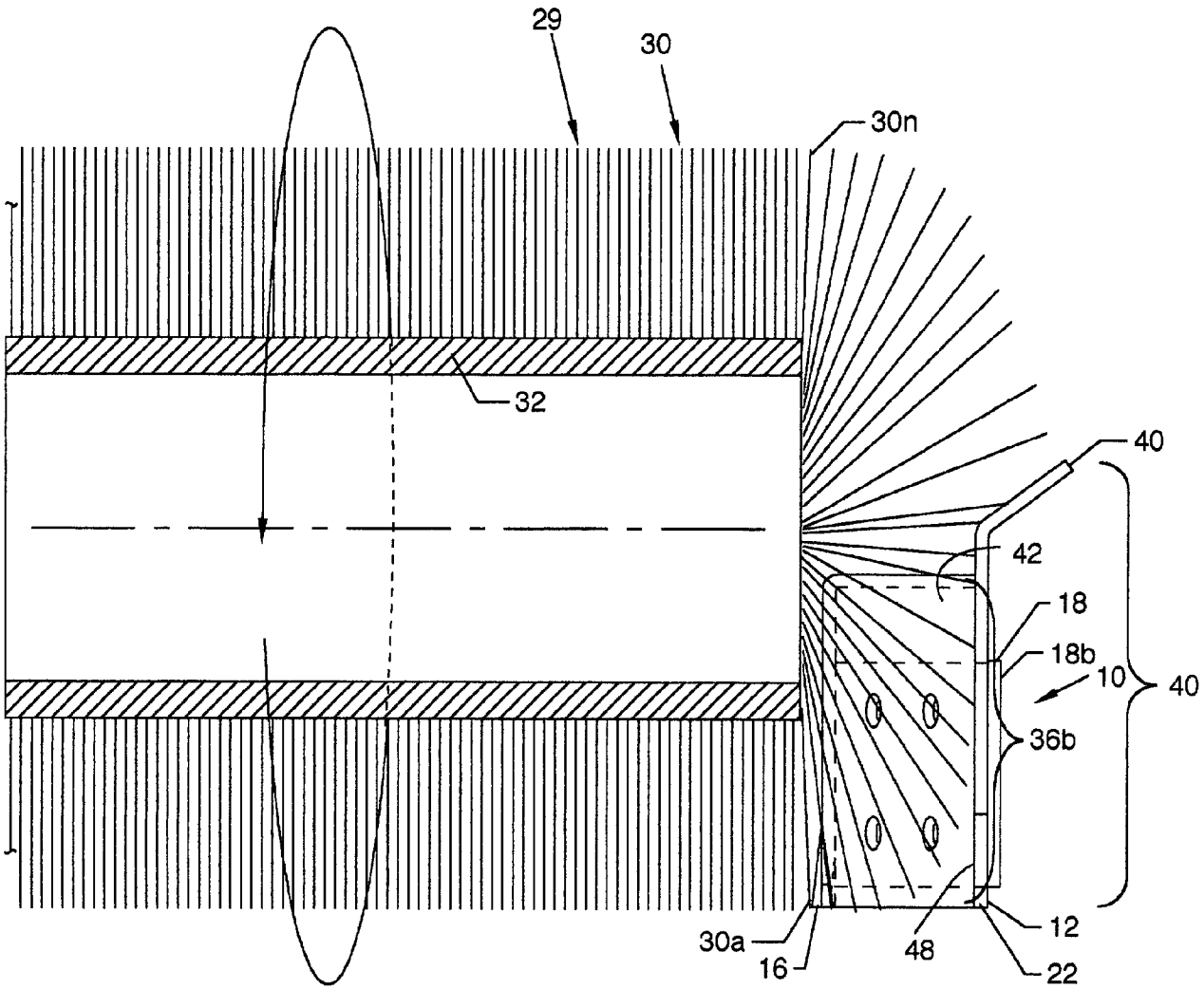
FIG. 6*b* illustrates a rear view of the rotary broom, shown in cross section, and the sweeper drag shoe, illustrating the interaction of the rotary broom with the deflection plate of the optional deflection plate extender; and, FIG. 7 illustrates a rear view of the rotary broom, shown in cross section, interacting with the forward contact region of the sweeper drag shoe.

FIG. 6*b*, a rear view, illustrates a portion of the outer bristles 30*a*–30*n* in contact with the rearward contact region 36*b* of the deflection plate 42, as well as the rearward contact region 36*c* of the containment plate 48 (not shown) of the optional deflection plate extender 40 attached to the sweeper drag shoe 10 where additional guidance of the outwardly splayed bristles 30*a*–30*n* is provided.

Figure 7:
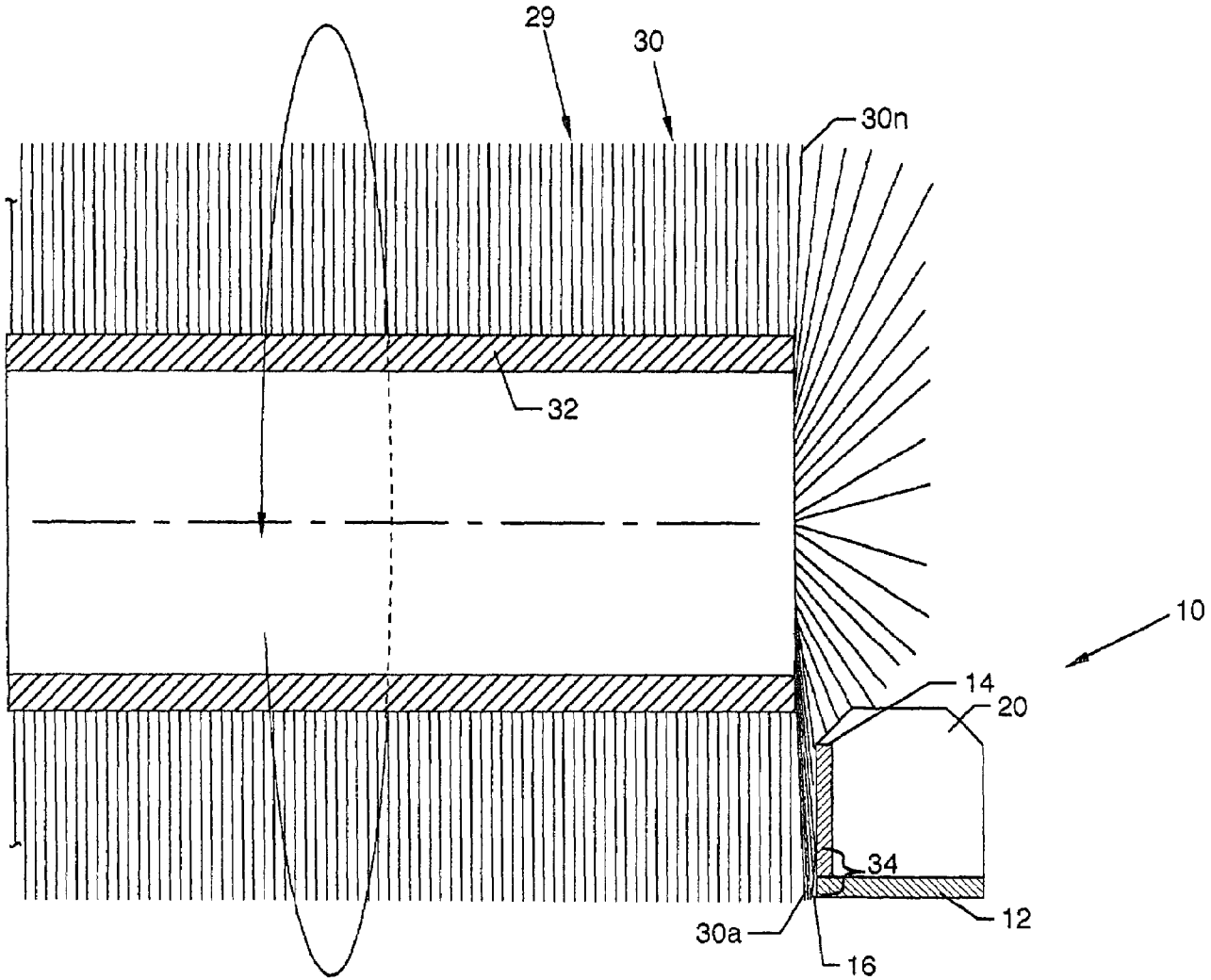

FIG. 7 illustrates a portion of the outer bristles 30*a*–30*n* in contact with the forward contact region 34 of the angled wedge 16 of the sweeper drag shoe 10. The tips of the outer bristles 30*a*–30*n* are urged inwardly during impingement with the angled wedge 16 to provide a densely concentrated and tightly formed rotating band or barrier of outer bristle tips 30*a*–30*n* to discourage dirt and debris migration at the end of the sweeping wedge and subsequent lodging beneath the contact skid 12.

Various modifications can be made to the present invention without departing from the apparent scope hereof.

The invention claimed is:

1. A sweeper drag shoe comprising:

a. a substantially right-angle member formed of a horizontally oriented elongated planar member having an upper surface, a lower surface, and first and second ends and a vertically oriented elongated planar member having a top edge, an inner surface, an outer surface, and first and second ends;

b. an elongated skirt member extending along the length of said inner surface of said vertically oriented elongated planar member from said first end thereof to said second end thereof and projecting outwardly away from said inner surface of said vertically oriented elongated planar member, said elongated skirt member having a horizontally oriented planar surface aligned with said lower surface of said horizontally oriented elongated planar member and a slanted surface extending from said horizontally oriented planar surface to a location on said inner surface of said vertically oriented elongated planar member below said top edge thereof; and, c. a vertically oriented plate member joined to said second end of said horizontally oriented elongated planar member, said vertically oriented plate member forming an obtuse angle with said outer surface of said vertically oriented elongated planar member and abutting said elongated skirt member at said second end of said vertically oriented elongated planar member.

2. The sweeper drag shoe as defined in claim 1, wherein said horizontally and vertically oriented elongated planar members form a right-angle member which is formed as two separate members which are joined together.

3. The sweeper drag shoe as defined in claim 2, wherein said elongated skirt member is a separate member joined to said vertically oriented elongated planar member.

4. The sweeper drag shoe as defined in claim 1, wherein said horizontally and vertically oriented elongated planar members form a right-angle member which is formed as a single, unitary, one-piece member.

5. The sweeper drag shoe as defined in claim 4, wherein said elongated skirt member is formed unitarily in one piece with said horizontally and vertically oriented elongated planar members.

6. The sweeper drag shoe as defined in claim 1, wherein said vertically oriented elongated planar member includes mounting holes extending therethrough from said outer surface to said inner surface above said elongated skirt member.

7. The sweeper drag shoe as defined in claim 1, further including an upwardly angled plate extending between said horizontally and vertically oriented elongated planar members at said first ends thereof.

8. The sweeper drag shoe as defined in claim 1, wherein said vertically oriented plate member is rectangular and extends vertically to a level above said top edge of said vertically oriented elongated planar member.

9. A sweeper drag shoe comprising:

a. an elongated, planar contact skid having an upper surface, a lower surface, a forward end, and a rearward end, said rearward end including a slanting edge;

b. an elongated, planar attachment bar having a top edge, an inner surface, an outer surface, a forward end, and a rearward end;

c. said contact skid extending perpendicularly to said attachment bar along the length of said attachment bar and being joined to said attachment bar along the length of said attachment bar from said forward end of said attachment bar to said rearward end of said attachment bar in such a manner that said upper surface of said contact skid together with said outer surface of said attachment bar form a right angle inside corner and said slanting edge of said rearward end of said contact skid extends beyond said rearward end of said attachment bar;

d. an angled skirt extending along said inner surface of said attachment bar from said forward end of said attachment bar to said rearward end of said attachment bar, said angled skirt having a bottom surface aligned with said lower surface of said contact skid and having a surface slanting from said bottom surface toward said top edge of said attachment bar and meeting said inner surface of said attachment bar below said top edge of said attachment bar; and, e. a deflection plate attached to said contact skid along said slanting edge of said rearward end of said contact skid, said deflection plate meeting said angled skirt at an angle.

10. The sweeper drag shoe as defined in claim 9, wherein said contact skid, said attachment bar, and said angled skirt are discrete, individually formed members.

11. The sweeper drag shoe as defined in claim 9, wherein said contact skid, said attachment bar, and said angled skirt are formed as a one-piece unitary member.

12. The sweeper drag shoe as defined in claim 9, wherein said attachment bar includes mounting holes extending therethrough from said outer surface to said inner surface above said angled skirt.

13. The sweeper drag shoe as defined in claim 9, further including an upwardly angled plate extending between said contact skid and said attachment bar at said forward end of said contact skid and said forward end of said attachment bar.

14. The sweeper drag shoe as defined in claim 9, wherein said deflection plate is rectangular and extends upwardly from said contact skid to a level above said top edge of said attachment bar.

15. A sweeper drag shoe comprising:

a. a contact skid for traveling along a roadway, said contact skid having a planar lower surface for facing the surface of the roadway, an upper surface, a forward end, and a rearward end;

b. an attachment bar joined to said contact skid and forming a right angle with said contact skid, said attachment bar projecting upwardly with respect to said upper surface of said contact skid;

c. an angled skirt extending along said attachment bar and having a planar bottom surface aligned with said planar lower surface of said contact skid and a slanting top surface; and, d. a deflection plate carried by said contact skid at said rearward end of said contact skid, said deflection plate meeting said angled skirt at an angle.

16. The sweeper drag shoe as defined in claim 15, further including an upwardly angled plate attached to said attachment bar and to said forward end of said contact skid.

* * * * *